US010669136B2

(12) United States Patent
Robb

(10) Patent No.: US 10,669,136 B2
(45) Date of Patent: Jun. 2, 2020

(54) CABLE TENSIONING DEVICE

(71) Applicant: Jeffrey Edward Robb, Cary, NC (US)

(72) Inventor: Jeffrey Edward Robb, Cary, NC (US)

( * ) Notice: Subject to any disclaimer, the term of this patent is extended or adjusted under 35 U.S.C. 154(b) by 0 days.

(21) Appl. No.: 15/914,684

(22) Filed: Mar. 7, 2018

(65) Prior Publication Data

US 2019/0276284 A1 Sep. 12, 2019

(51) Int. Cl.

| | |
|---|---|
| ***B66D 1/50*** | (2006.01) |
| ***B66C 13/06*** | (2006.01) |
| ***B66C 13/10*** | (2006.01) |
| ***B63B 27/08*** | (2006.01) |
| ***B66C 23/52*** | (2006.01) |

(52) U.S. Cl.

CPC ..... *B66D 1/50* (2013.01); *B63B 27/08* (2013.01); *B66C 13/06* (2013.01); *B66C 13/10* (2013.01); *B66C 23/525* (2013.01); *B66D 2700/0166* (2013.01)

(58) Field of Classification Search

CPC ..... B66D 1/50; B66C 13/06; B66C 13/10; B66C 23/525; B63B 27/08

See application file for complete search history.

(56) References Cited

U.S. PATENT DOCUMENTS 522,524 A * 7/1894 Hook ..... B63B 21/08 114/101
845,143 A * 2/1907 Taylor ..... B66C 23/20 212/179
1,511,297 A * 10/1924 Pennoyer ..... B66C 23/163 212/201
2,465,604 A * 3/1949 Potter ..... B63B 21/16 254/283
2,942,740 A * 6/1960 Pristach ..... B63B 27/18 104/114
2,946,559 A * 7/1960 Pickett ..... B65H 57/14 254/134.3 PA
3,199,553 A * 8/1965 Garrett ..... B63B 27/18 137/615
3,908,962 A * 9/1975 Ross ..... E21F 17/06 254/134.3 R
4,034,963 A * 7/1977 Warman ..... B66D 1/50 254/273
4,126,298 A * 11/1978 Lub ..... B66C 13/02 212/308
4,271,970 A * 6/1981 Miller ..... B66C 13/02 212/232
4,557,390 A * 12/1985 Mick ..... B66C 23/36 212/197
4,846,446 A * 7/1989 Peppel ..... B63B 21/00 254/277
4,989,903 A * 2/1991 McAllister ..... F16L 3/01 285/114
5,901,651 A * 5/1999 Boyd ..... H02G 1/04 104/112

(Continued)

*Primary Examiner* — Michael E Gallion

(74) *Attorney, Agent, or Firm* — Dunlap Bennett & Ludwig PLLC

(57) ABSTRACT

An affordable tension device for maintaining tension on a wire rope of a cable-based lifting system is provided. The tension device has an elongated casting weight adapted to govern the casting weight as it rides along a predetermined wire rope for maintaining tension thereon. The tension device provides a clevis with a sheave for operatively associating with the tension wire rope.

8 Claims, 3 Drawing Sheets

(56) References Cited

U.S. PATENT DOCUMENTS

| | | | | |
|---|---|---|---|---|
| 6,027,103 | A * | 2/2000 | Painter | B66D 1/12 254/332 |
| 6,045,124 | A * | 4/2000 | Walton | G02B 6/4465 254/134.3 PA |
| 6,315,269 | B1 * | 11/2001 | Fleury | B66D 3/046 254/134.3 PA |
| 7,913,726 | B1 * | 3/2011 | Honnell | B27L 7/06 144/193.1 |
| 9,127,788 | B2 * | 9/2015 | Jones | G02B 6/483 |
| 9,350,145 | B2 * | 5/2016 | Jean | H02G 1/02 |
| 9,802,800 | B2 * | 10/2017 | Kalakay, Jr. | B66D 3/26 |
| 9,948,076 | B1 * | 4/2018 | Davey | B65H 49/205 |
| 2003/0136752 | A1 * | 7/2003 | Lee | B66C 13/10 212/323 |
| 2009/0001040 | A1 * | 1/2009 | Kleiss | B66C 1/104 212/242 |
| 2009/0095944 | A1 * | 4/2009 | Gaines | B66C 23/005 254/334 |
| 2011/0251803 | A1 * | 10/2011 | Teurlay | G01L 5/103 702/43 |
| 2014/0021421 | A1 * | 1/2014 | Torben | B66D 1/50 254/277 |
| 2016/0109341 | A1 * | 4/2016 | Cao | B66D 1/50 73/829 |
| 2017/0015530 | A1 * | 1/2017 | Southerland, Jr. | B66C 13/06 |

* cited by examiner

CABLE TENSIONING DEVICE

BACKGROUND OF THE INVENTION

The present invention relates to a device for maintaining tension on a wire rope and, more particularly, to a tension device for maintaining tension on a wire rope or cable that rides a winch drum.

Cable-based systems adapted to move cargo utilizing winches and/or pulley assemblies are susceptible to slack in the wire rope backlashing on the drum, preventing further pay out of the wire rope off the drum. Backlashing is usually caused by the absence of an overhauling load on the wire rope during some phase of winch operation.

Backlashing is a hazard to equipment during all winch-based systems, and is a serious hazard to personnel during replenishment activities at sea when the wire rope is connected between two ships, as any increase in separation distance between the two ships may result in increased tension on the wire rope.

As can be seen, there is a need for an affordable tension device for maintaining tension on a wire rope of a cable-based lifting system.

SUMMARY OF THE INVENTION

In one aspect of the present invention, a tension device for maintaining tension of a wire rope of a cable-based lifting system includes an elongated casting weight extending from a first and to a second end, defining an elongated ratio of a length to a width; and a sheave couple to the first end.

In another aspect of the present invention, the tension device for maintaining tension of a wire rope of a cable-based lifting system includes an elongated casting weight extending from a first and to a second end, defining an elongated ratio of a length to a width of approximately 3:1, wherein the length ranges between 13 and 15, and wherein the casting weight has a mass in the range of 13 and 15 inches; a sheave couple to the first end; and a clevis interconnecting the first end and the sheave.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an affordable tension device for maintaining tension on a wire rope of a cable-based lifting system. The tension device has an elongated casting weight adapted to govern the casting weight as it rides along a predetermined wire rope for maintaining tension thereon. The tension device provides a clevis with a sheave for operatively associating with the tension wire rope.

Referring to FIGS. 1 through 4, the present invention may include a tension device 10 for maintaining tension on a wire rope 22 of a cable-based lifting system.

Figure 1:
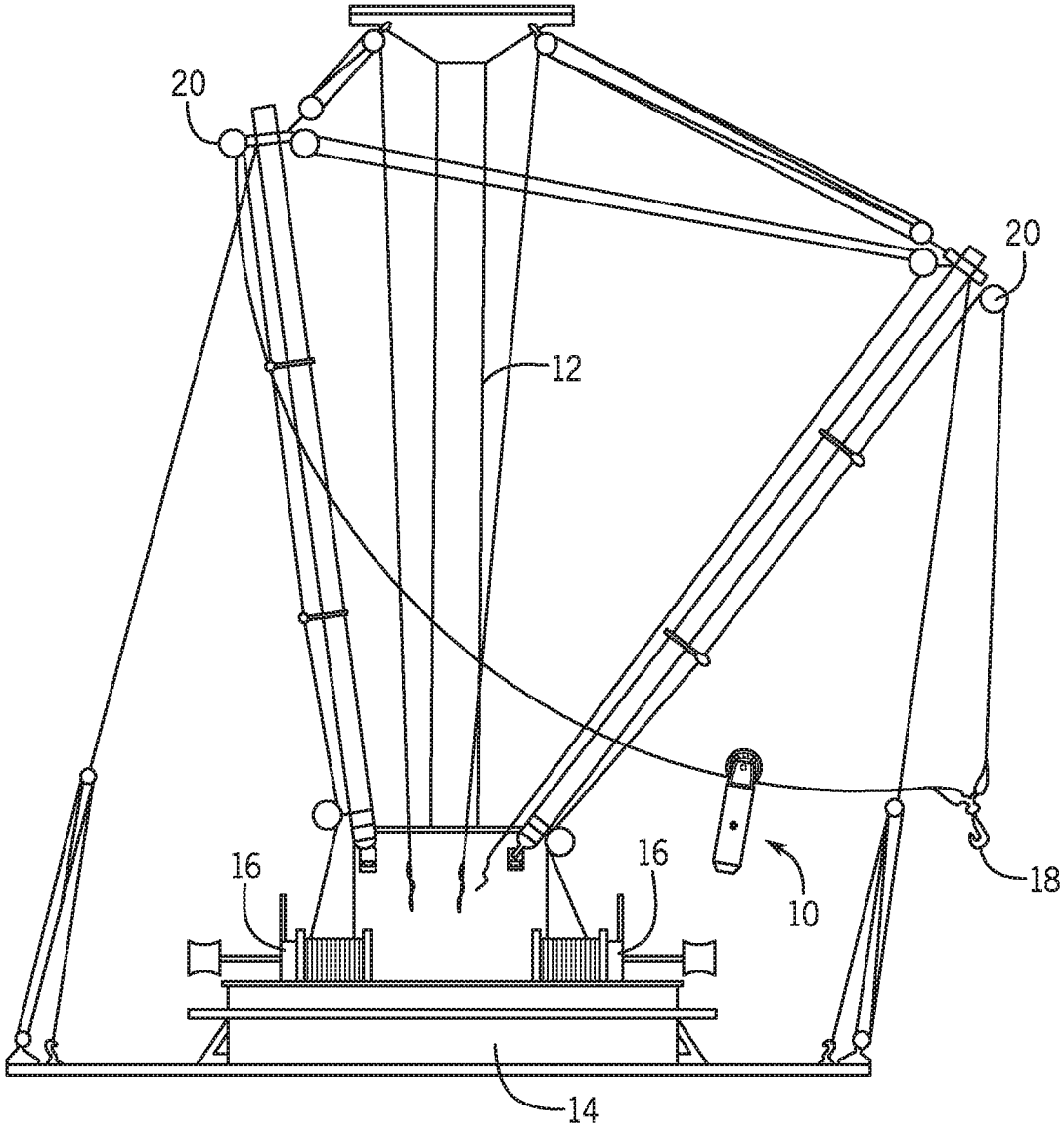
FIG. 1 is a side elevation view of an exemplary embodiment of the present invention, shown in use.
Figure 2:
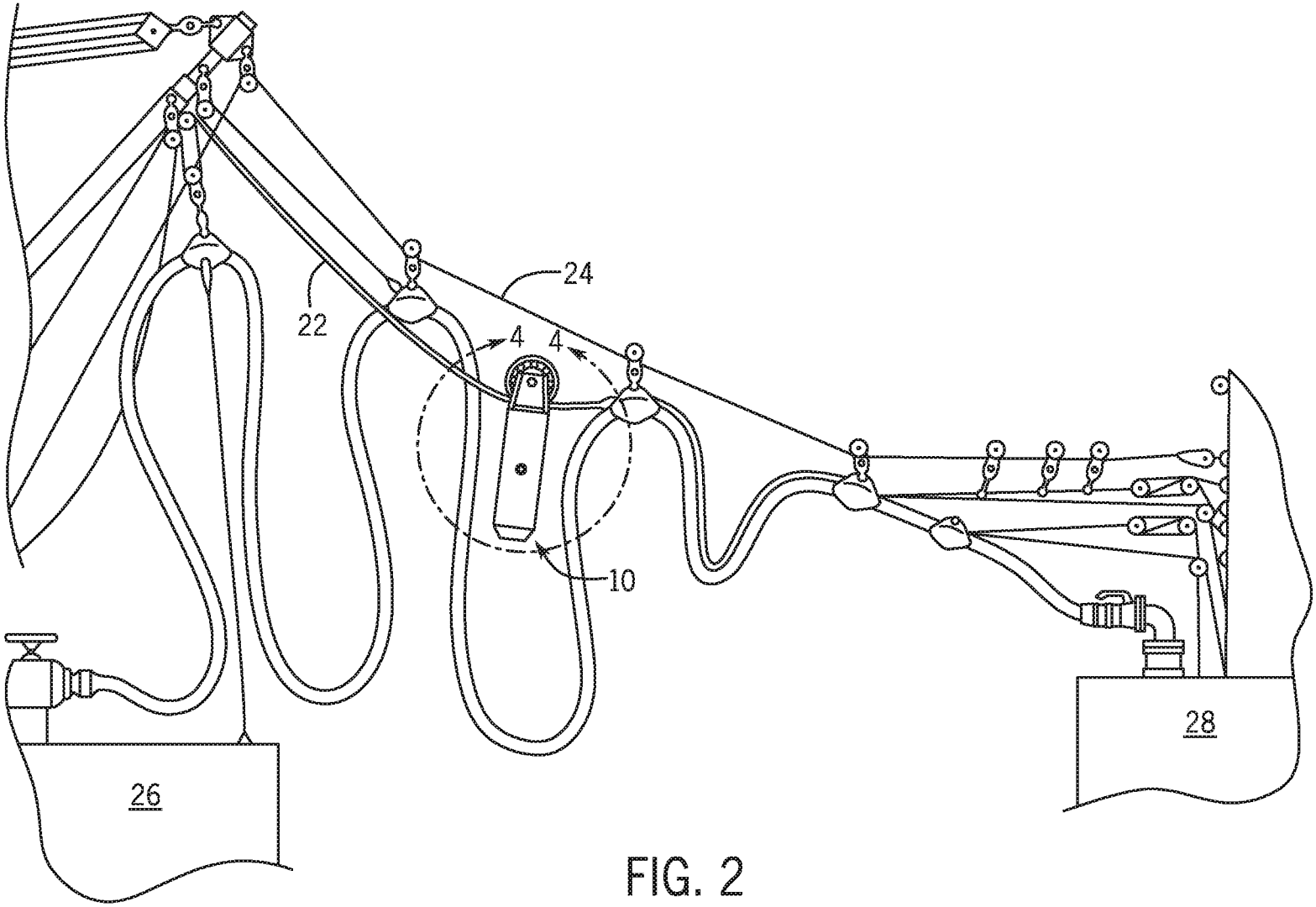
FIG. 2 is a detailed view of an exemplary embodiment of the present invention, shown in use.

Referring to FIGS. 1 and 2, the cable-based lifting system may include a mast 12, a hatch coaming 14, one or more pulley blocks 20, a cargo hook 18, a span wire 24 and at least one winch 16 engaging the wire rope 22. As mentioned above, the cable-based lifting system can be purposed for replenishment activities at sea when the wire rope 22 is connected between two ships, a delivering ship 26 and a receiving ship 28, as illustrated in FIG. 2.

Figure 4:
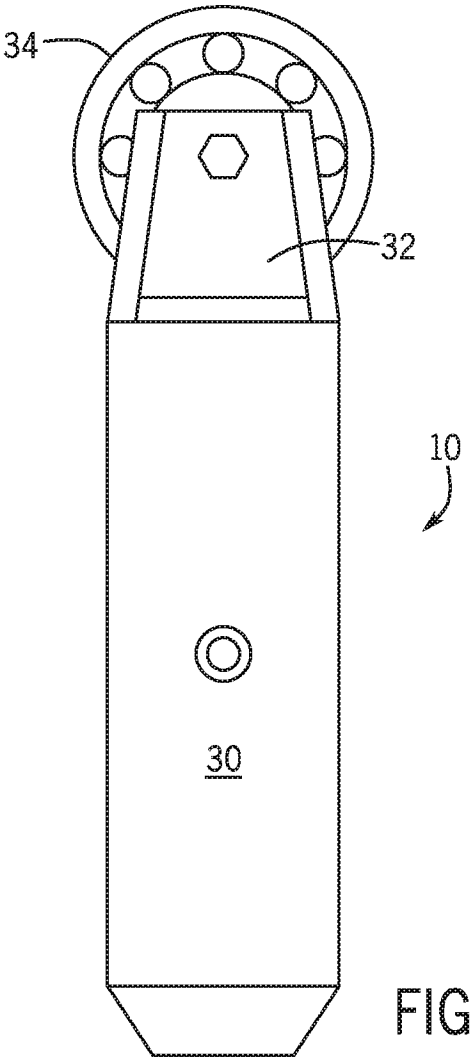
FIG. 4 is a side view of an exemplary embodiment of the present invention.
Figure 3:
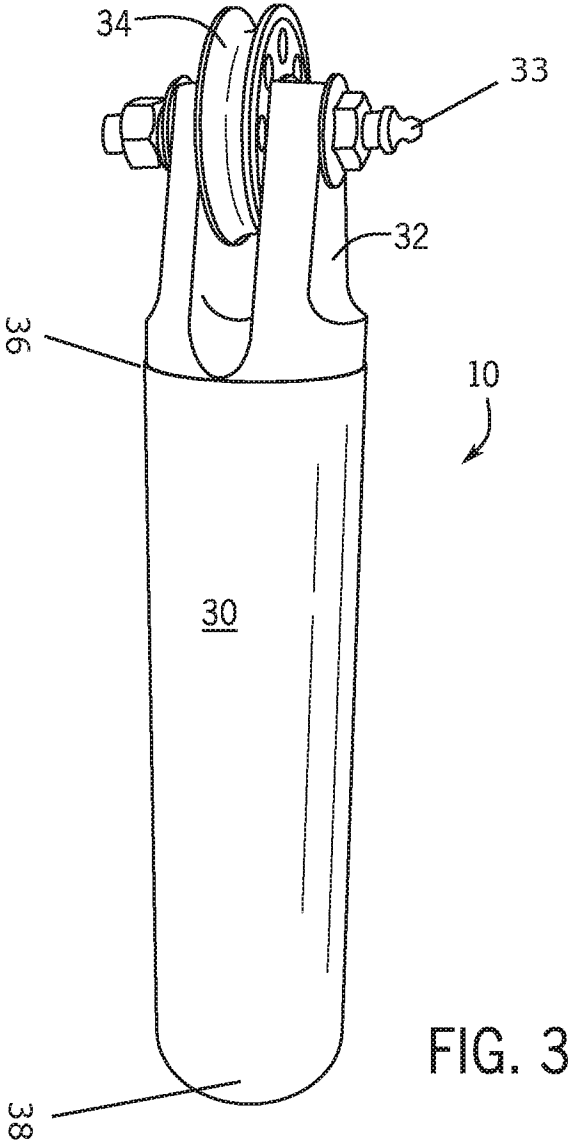
FIG. 3 is a perspective view of an exemplary embodiment of the present invention.

Referring to FIGS. 3 and 4, the tension device 10 may include an elongated casting weight 30 extending from a first end 36 to a second end 38, defining an elongated ratio of length to width that is approximately 3:1. The tension device 10 provides a clevis 32 attached to the first end 36. The interconnecting member 33 of the clevis 32 can securely engage with a sheave 34, that in turn can operatively associates with the wire rope 22. From the experience of the inventor, the elongated length can be approximately between 13 and 15 inches, and the casting weight 30 can have a mass in the range of 25 to 35 pounds, the mass being generally uniformly distributed along the elongated ratio.

A method of using the present invention may include the following. The tension device 10 disclosed above may be provided. A user would slack down the wire rope 22 on the winch 16 to operatively associate the tension device 10 via the interconnecting member 33 to the wire rope 22. The elongated ratio of the casting weight 30 facilitates the casting weight 30 travelling in a controlled manner along the wire rope 22 when tensioned. The elongated ratio causes the casting weight 30 to experience drag as it rides the wire rope 22, controlling (slowing) the ride of the tension device 10 along the wire rope 22, thereby preventing the tension device 10 from overshooting the optimal location along the wire rope 22 for maintaining tension thereon.

It should be understood, of course, that the foregoing relates to exemplary embodiments of the invention and that modifications may be made without departing from the spirit and scope of the invention as set forth in the following claims.

What is claimed is:

1. A tension device for maintaining tension of a wire rope of a cable-based lifting system by travelling along said wire rope, comprising:

a substantially cylindrical elongated casting body extending from a first end to a second end, defining an elongated ratio of a length to a width; and a sheave coupled to the first end, wherein the second end has no connections thereby facilitating the elongated casting body travelling along a wire rope.

2. The tension device of claim 1, further including a clevis interconnecting the first end and the sheave.

3. The tension device of claim 1, wherein the elongated ratio is approximately 3:1.

4. The tension device of claim 1, wherein the length ranges between 13 and 15 inches.

5. The tension device of claim 1, wherein the casting body has a mass in the range of 25 to 35 pounds.

6. A tension device for maintaining tension of a wire rope of a cable-based lifting system, comprising:

a substantially cylindrical elongated casting body extending from a first end to a second end, defining an elongated ratio of a length to a width of approximately 3:1, wherein the length ranges between 13 and 15 inches, and wherein the elongated casting body has a mass in the range of 25 to 35 pounds;

a sheave coupled to the first end, wherein the second end has no connections thereby facilitating the elongated casting body travelling along a wire rope; and a clevis interconnecting the first end and the sheave.

7. A method for maintaining tension on a wire rope of a cable-based lifting system, comprising the steps of:

providing the tension device of claim 1;

operatively associating the wire rope with the sheave; and tensioning the wire rope by riding the tension device along the wire rope through slacking down said wire rope.

8. The tension device of claim 1, wherein the entire second end is defined by a continuous periphery that defines a bowl-shape having an unbroken exterior surface.

* * * * *